United States Patent [19]

Yamada et al.

[11] 4,356,846

[45] Nov. 2, 1982

[54] APPARATUS FOR STRANDING MULTI-LAYER CABLE

[75] Inventors: Minoru Yamada, Mississauga; Rokuzo Ito, Toronto, both of Canada

[73] Assignee: Canada Wire and Cable Limited, Toronto, Canada

[21] Appl. No.: 133,925

[22] Filed: Mar. 25, 1980

[30] Foreign Application Priority Data

Jan. 9, 1980 [CA] Canada ..... 343337

[51] Int. Cl.[3] ..... D07B 3/00

[52] U.S. Cl. ..... 140/115; 57/138; 140/147

[58] Field of Search ..... 140/111, 113, 115, 116, 140/122, 147, 149; 57/138, 311, 58.38

[56] References Cited

U.S. PATENT DOCUMENTS

| | | | |
|---|---|---|---|
| 359,410 | 3/1887 | Stone | 57/138 |
| 2,280,500 | 4/1942 | Reyburn | 140/149 |
| 2,724,944 | 11/1955 | Carleton | 57/138 |
| 3,343,574 | 9/1967 | Mersek | 140/147 |
| 3,364,289 | 1/1968 | Campbell | 57/311 |
| 3,425,203 | 2/1969 | Schillebeecky | 57/58.38 |
| 3,641,755 | 2/1972 | Heinen et al. | 57/138 |
| 4,182,106 | 1/1980 | Henry | 57/311 |

FOREIGN PATENT DOCUMENTS

| | | | |
|---|---|---|---|
| 914168 | 10/1946 | France | 140/149 |

*Primary Examiner*—John McQuade

*Attorney, Agent, or Firm*—Fleit & Jacobson

[57] ABSTRACT

An apparatus for stranding an outer layer of wires on an inner layer cable core is disclosed. The apparatus comprises a tubular stranding machine comprising a rotating tube within which are stationary mounted on the same axis a series of cradles each supporting a spool of wire from which are paid-off the outer wires, means for guiding said outer wires along the outside wall of said tube towards a stranding die located at the front of the stranding machine, means for guiding a cable core originating from the back of the stranding machine along the outside wall of the tube, and a wire straightener stationary mounted at the front of the stranding machine ahead of the stranding die and through which is passed the cable core to eliminate the waviness of the cable core due to rotation during traveling along the outside wall of the tube.

5 Claims, 3 Drawing Figures

APPARATUS FOR STRANDING MULTI-LAYER CABLE

This invention relates to an apparatus for stranding multi-layer cables.

A multi-layer stranded cable is conventionally manufactured by a planetary type stranding machine, a rigid frame type stranding machine, a tubular type stranding machine, or a combination of a tubular type and rigid frame type stranding machine. The planetary type and the rigid frame type stranding machines comprise a number of spool holders mounted on a rotatable frame and each supporting a wire spool from which are paid-off the wires of the cable, whereas the tubular stranding machines comprise a long tube within which are mounted on the same axis a series of cradles each supporting a wire spool. Because of their heavy mass at a large radius of rotation, planetary type and rigid frame type stranding machines operate at a slower speed than the tubular type stranding machines. However, due to their high speed, tubular stranding machines cause waviness of multi-layer cables because the cable core travels along the entire tube length of the machine and rotates with the tube before being wrapped by the outer layer wires.

It is therefore the object of the present invention to provide an apparatus which eliminates the waviness of multi-layer cables being manufactured at high speed using a tubular stranding machine.

The apparatus, in accordance with the invention, comprises a tubular stranding machine comprising a rotary tube within which are stationarily mounted on the same axis a series of cradles each supporting a spool or wire from which are paid-off the outer wires, means for guiding the outer wires along the outside wall of the tube towards a stationary die located at the front of the stranding machine, means for guiding a cable core originating from the back of the stranding machine along the outside wall of the tube, and a wire straightener stationarily mounted at the front of the stranding machine ahead of the stranding die and through which is passed the cable core to eliminate the waviness of the cable core due to rotation during traveling along the outside wall of the tube.

The cable core is made of a central wire upon which is stranded at least one layer of wires. The cable core may be paid-off from a spool located at the back of the stranding machine or from a previous stranding machine.

The wire straightener is preferably mounted on ball bearings on the same axis as the tube and weighted to maintain it stationary. The wire straightener is preferably a two-plane roll straightener.

The invention will now be disclosed, by way of example, with reference to the accompanying drawings in which.

Figure 1:
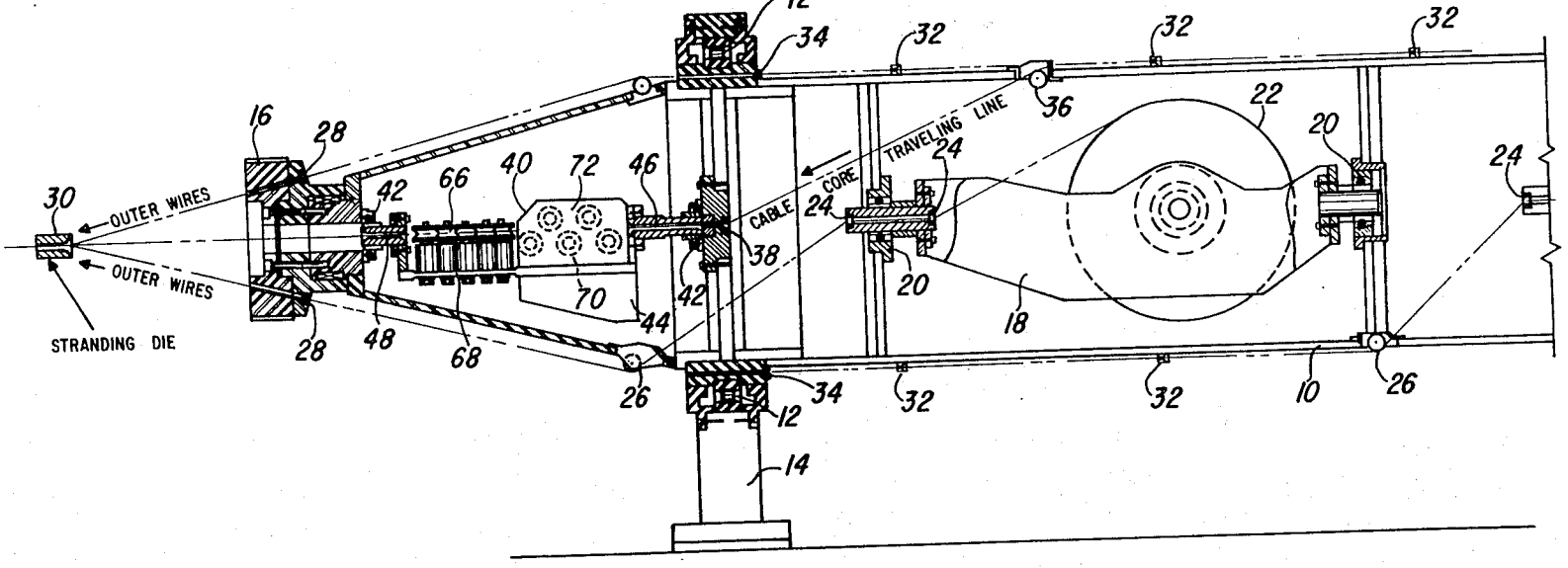
FIG. 1 illustrates the front end of a tubular stranding machine equipped with a wire straightener.

Referring to FIG. 1, there is shown the front end of a conventional tubular stranding machine comprising a long tube 10 of large diameter which is journalled in suitable bearings 12 supported on a plurality of pillars 14. The tube is rotated at a controlled speed by any suitable drive through a pulley 16. A series of cradles 18 are mounted on ball bearings 20 within the tube 10 and weighted so that they do not rotate within the tube. Each cradle supports a wire spool 22. The wire from the first spool is passed through guiding dies 24 concentric with bearing 20 and then out of the tube around a guiding roller 26 and through guiding die 28 in pulley 16 up to a conventional stranding die 30. The wires from the spools which are located further away in the tube are guided by additional guiding eyelets 32 and guiding dies 34 in bearings 12. The wire spools provide the required number of wires for a full layer of wires stranded or wrapped around a cable core. Such cable core is fed from the back of the stranding machine and is guided by suitable eyelets along the outside wall of the tube up to a guiding roller 36 and then inside the tube through a central guiding die 38 and towards the stranding die 30. The above tubular stranding machine is conventional and will not be disclosed in more detail.

In accordance with the present invention, the cable core is fed to the stranding die 30 through a wire straightener 40 which is mounted on bearings 42 and maintained stationary by means of off-center weight 44. The cable core coming out of guiding die 38 is passed through a first guiding tube 46, the wire straightener 40, a second guiding tube 48 and then through the stranding die 30.

Figure 2:
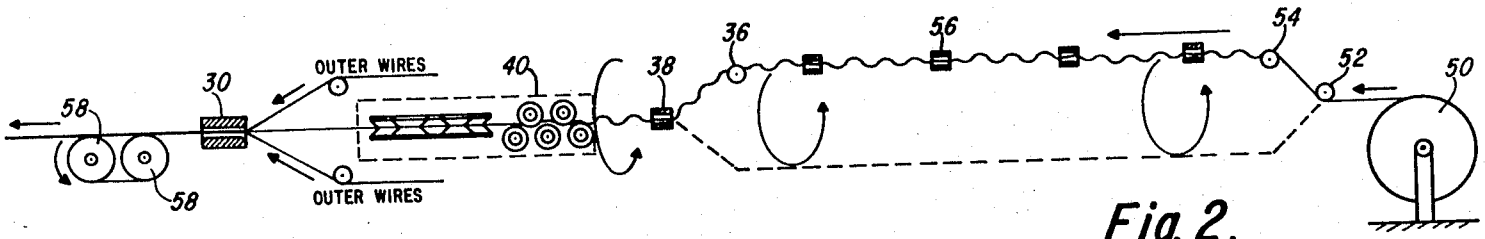
FIG. 2 illustrates a schematic view of the apparatus in accordance with the invention.

FIG. 2 of the drawings illustrates schematically the path of the cable core from a pay-off device 50 through guiding roller 52 located at the back of the tubular machine, through guiding roller 54, guiding eyelets 56 and guiding roller 36 located on the tube wall, and then through guiding die 38, wire straightener 40 and stranding die 30. The cable core is drawn by pulley capstan 58.

Figure 3:
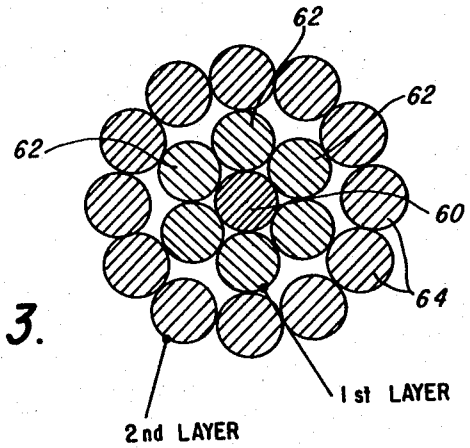
FIG. 3 illustrates a cross-section through a multi-layer cable.

The cable core may comprise a central conductor 60 around which is wrapped a first layer of wire 62 as shown in FIG. 3 of the drawings. It is to be understood, however, that the cable core may comprise more than one layer of wires.

The cable core rotates with the tube between guiding roller 52 and guiding die 38 and such rotation at high speed renders the cable core wavy as shown schematically in FIG. 2. However, after passing through the straightener 40, the waviness is removed and the cable core is then wrapped with the outer layer wires as shown schematically in FIG. 2. The outer layer wires 64 form the second layer of wires as shown in FIG. 3 of the drawings.

The wire straightener 40 is of a type known in the art and comprises two rows of rollers 66 mounted on a plate 68 and two rows of rollers 70 mounted on a plate 72 which is at 90° with plate 68. The rollers of each row are slightly staggered so that the cable core follows a sinusoidal path through the rollers and is straightened by passing therethrough. The straightener is conventional and is known as a two plane roll straightener. A suitable example is Model 778 sold by Sjogren Tool & Machine Co. Inc.

Although the invention has been disclosed with reference to a preferred embodiment, it is to be understood that it is not limited to such embodiment and that other alternatives are also envisaged.

The embodiments of the invention in which an exclusive property or privilege is claimed are defined as follows:

1. An apparatus for stranding an outer layer of wires on an inner layer cable core comprising:

(a) a tubular stranding machine comprising a rotating tube within which are stationarily mounted on the same axis a series of cradles each supporting a spool of wire from which are paid-off the outer wires;

(b) means for guiding said outer wires along the outside wall of said tube towards a stranding die located at the front of the stranding machine;

(c) means for guiding a cable core originating from the back of the stranding machine along the outside wall of said tube and then inside the tube through a guiding die located on the same axis as the tube, towards said stranding die; and (d) a wire straightener stationarily mounted on the axis of the tube between the guiding die and the stranding die and through which is passed the cable core to eliminate the waviness of the cable core due to rotation during traveling along the outside wall of the tube.

2. An apparatus as defined in claim 1, wherein the cable core is made of a central wire upon which is stranded at least one layer of wires.

3. An apparatus as defined in claim 1 or 2, further comprising a spool located at the back of the stranding machine and from which the cable core is paid-off.

4. An apparatus as defined in claim 1, wherein said wire straightener is mounted on bearings on the same axis as the tube and provided with an off-center weight to maintain it stationary.

5. An apparatus as defined in claim 4, wherein said wire straightener is a two plane roll straightener.

* * * * *